United States Patent [19]

Simmons et al.

[11] Patent Number: 5,058,654

[45] Date of Patent: Oct. 22, 1991

[54] METHODS AND APPARATUS FOR TRANSPORTING PORTABLE FURNACES

[75] Inventors: Wyman D. Simmons, Coker, Ala.; Eugene C. Mitchell, Stone Lake, Wis.

[73] Assignee: Outboard Marine Corporation, Waukegan, Ill.

[21] Appl. No.: 549,230

[22] Filed: Jul. 6, 1990

[51] Int. Cl.[5] ..... B22D 41/01

[52] U.S. Cl. ..... 164/47; 164/133; 164/335

[58] Field of Search ..... 164/47, 76.1, 133, 136, 164/335, 412

[56] References Cited

U.S. PATENT DOCUMENTS 3,159,704 12/1964 Marsteller .
3,791,535 2/1974 Baker et al. .
4,156,452 5/1979 Sharkey .
4,230,308 10/1980 Gueguen .

FOREIGN PATENT DOCUMENTS 1017434 5/1983 U.S.S.R. ..... 164/335

*Primary Examiner*—Kuang Y. Lin
*Attorney, Agent, or Firm*—Welsh & Katz, Ltd.

[57] ABSTRACT

Apparatus for transporting and guiding a portable furnace to transfer molten material from the furnace to a die cast machine includes a platform which supports the furnace. The platform has wheels at one end and fixed legs at the other end. The wheels roll on rails secured to the floor which guide the platform to a predetermined position, and a stop locates the platform in the proper position. The furnace is placed on the platform when the platform is in an aisle adjacent the machine, and the platform is pushed into place by lifting the fixed legs and pushing the platform. After the operation of the machine, the furnace can be removed by pulling the platform into the aisle and lifting the furnace off of the platform. The furnace can then be moved to another platform to transfer molten material to another machine.

6 Claims, 1 Drawing Sheet

METHODS AND APPARATUS FOR TRANSPORTING PORTABLE FURNACES

This invention relates to methods and apparatus for transporting furnaces, and more particularly, to methods and apparatus for efficiently moving a portable furnace and precisely locating it among a plurality of die cast machines.

BACKGROUND OF THE INVENTION

Die cast parts can be mass produced by operating several die cast machines in a single manufacturing facility. The die cast machines require molten material, which is generally provided by a large holding furnace which melts raw material to a desired temperature and maintains it in a molten state for transfer to a smaller furnace dedicated to each machine.

Generally, a holding furnace is provided for each die cast machine. However, due to production schedules and servicing requirements, not all machines are used simultaneously. This is not energy efficient because the furnaces must maintain the raw material in a molten state even when the die cast machine is not in operation. It also increases capital and operating costs because furnaces are purchased and maintained even though there are times when some of the furnaces are not used. Thus, there is a need for methods and apparatus for reducing the number of holding furnaces needed to operate several die cast machines in a single manufacturing facility.

A single holding furnace can be moved among several die cast machines, but the furnace may have to be positioned at different heights for different size die casting machines. Thus there is also a need for methods and apparatus for reducing the number of holding furnaces needed to operate several die cast machines which require the holding furnace to be at different heights.

Accordingly, one object of this invention is to provide new and improved methods and apparatus for reducing the number of furnaces needed to operate several die cast machines in a manufacturing facility.

An additional object is to provide new and improved methods and apparatus for reducing the number of furnaces needed to operate several die cast machines which require the holding furnace to be at different heights.

Another object if to provide new and improved methods and apparatus for transporting portable furnaces.

Still another object is to provide new and improved methods and apparatus for accurately and efficiently moving a portable furnace and precisely locating it among a plurality of die cast machines.

Yet another object is to provide new and improved methods and apparatus for making parts in die cast machines.

SUMMARY OF THE INVENTION

In keeping with one aspect of this invention, apparatus for transporting and locating a portable furnace in a desired position with respect to a die cast machine includes a platform which supports the furnace. The height of the platform is set so that the furnace is at a desired height with respect to the die cast machine when the furnace is on the platform. The platform has wheels at one end and fixed legs at the other end. The wheels are guided by rails secured to the floor, and a stop, secured to the floor or rails, locates the platform precisely in a predetermined position. In this manner, the furnace is properly placed for transferring molten material to the die cast machine.

The furnace is placed on the platform when the platform is in an aisle adjacent the machine, and the platform is pushed into place by lifting the end near the fixed legs and pushing the platform and furnace to the proper position for providing molten metal from the furnace to the machine during the machine's operation. After a run of parts is completed, or if the machine or furnace becomes inoperable for any reason, the furnace can be removed by lifting the platform near the end where the fixed legs are located, pulling the platform into the aisle and lifting the furnace from the platform. The furnace can then be moved to another platform to provide molten material to another die cast machine.

BRIEF DESCRIPTION OF THE DRAWINGS

The above-mentioned and other features of an embodiment of this invention and the manner of obtaining them will become more apparent, and will be best understood by reference to the following description, taken in conjunction with the accompanying drawings, in which.

DETAILED DESCRIPTION

Figure 1:
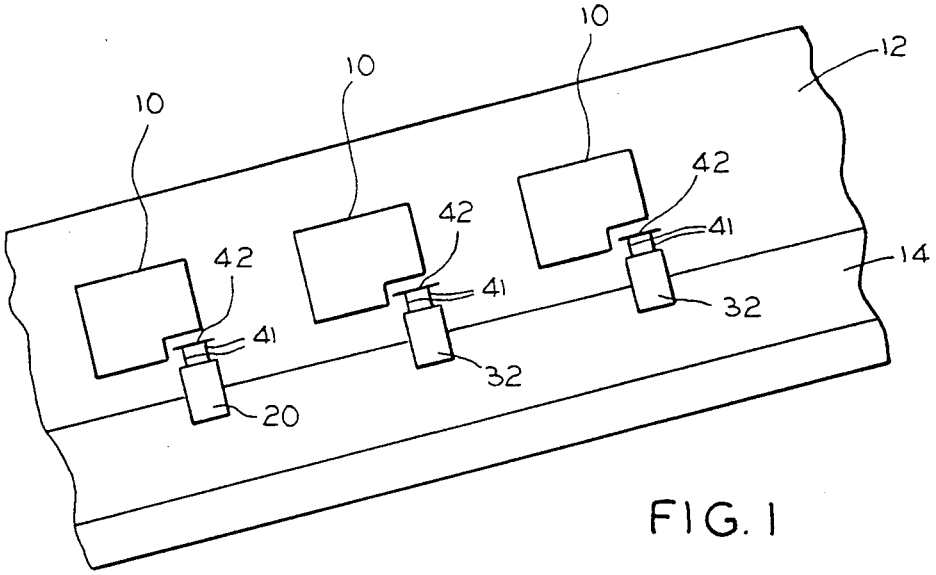
FIG. 1 is an overhead plan view showing the manner in which the apparatus of this invention can be used.

As seen in FIG. 1, apparatus for mass producing die cast parts includes a plurality of die cast machines 10 located on a floor 12 of a manufacturing facility. The machines may be arranged in any suitable manner, provided that each machine is accessible from a common area such an aisle 14. Also, the machines 10 may be of different size.

Figure 2:
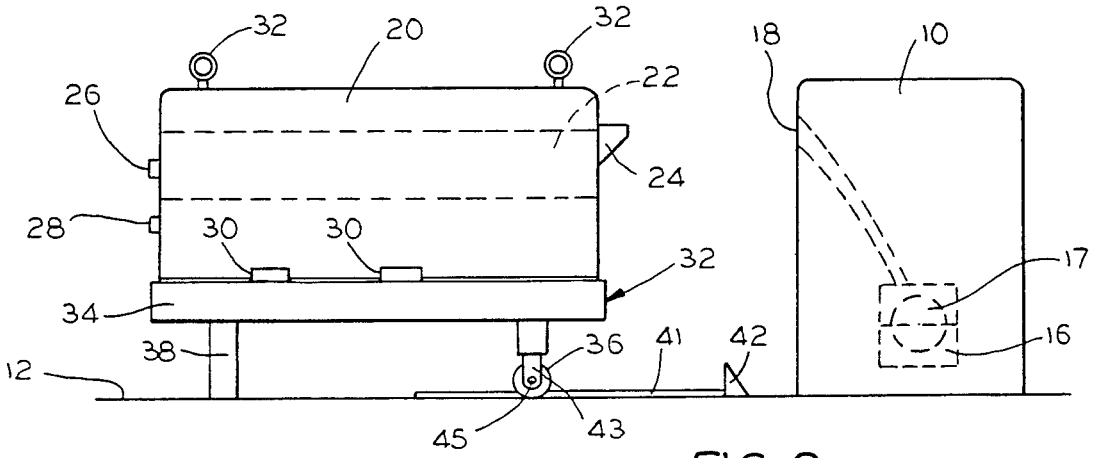
FIG. 2 is a side elevational view of the apparatus of this invention.

Each machine 10 includes one die 16 (FIG. 2) and a shot well 18 in which molten material, such as an aluminum alloy is poured for producing a piece part 17 in the die 16. Molten material must be poured into the shot well 18 for each cycle of the machine 10. However, no molten material is needed when production schedules do not require that a particular machine be operated, or if servicing needs require that the machine not be operated for a period of time.

The molten material required for a selected machine 10 which is to be operated at a particular time is provided by a portable holding furnace 20. The furnace 20 includes a reservoir 22 of molten material, an outlet 24, a connection 26 for electric energy, and a connection 28 for natural gas or any other suitable sources of energy for maintaining the raw material in its molten state and operating the furnace 20.

The furnace 20 also includes two openings 30 in the bottom of the furnace 20 which are spaced to accept the forks of a fork lift truck. With the openings 30, a fork lift truck can lift the furnace 20 and move it. The openings 30 preferably extend to both sides of the furnace 10, so that the furnace 20 can be lifted from either side. One or more eyes 32 can also be provided, if desired, so that the furnace 20 can be moved with an overhead hoist or crane, if desired.

A platform 32 is provided for each machine 10. Each platform 32 includes a base 34, one or more wheels 36 on leg 37 and one or more fixed legs 38. The legs 37, 38 set the height of the platform 32 so that the furnace 10 is at the proper height with respect to the die cast machine 10. If only one height is needed for all of the machines 10, then a single platform 32 can be secured to or built into the furnace 20 and moved with the furnace 20 to each machine 10.

The platforms 32 can be moved by lifting the base 34 adjacent the fixed legs 38 and pushing the platform 32. The base 34 can be lifted with a fork lift truck, for example, by placing the forks under the base 34. Other configurations could be used to move the platforms 32, provided that the platforms 32 can be easily and precisely moved without spilling molten material, and efficiently secured in place in a desired position.

The wheels 36 include circumferential grooves 40 which ride over one or more rails 41 secured to the floor 12. At least one, and preferably two, rails 41 are provided for each machine 10. The rails 41 guide the platforms 32 as the platforms 32 are moved towards and away from the machines 10. However, the weight on the wheels 41 is supported by the floor 12, and not the rails 41, although it is contemplated that the weight could be placed on the rails 41, as well.

Figure 3:
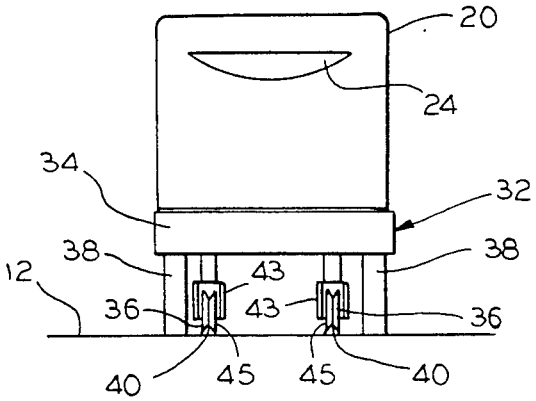
FIG. 3 is an end elevational view of the apparatus of this invention.

The wheels 41 are secured to the platforms 32 by inverted U-shaped members 43 and axles 45, as seen in FIG. 3, although the wheels 41 could be supported by any other suitable structure.

The platforms 32 are stopped at their predetermined positions by one or more stops 42 secured to the rails 41 or the floor 12. The stops 42 are located so that the wheels 36 of each platform 32 abut one of the stops 42 to stop the platforms 32, although other structure could be provided to abut the stops 42, if desired.

The stops 42 are located so that the furnace outlet 24 is properly aligned with the shot well 18 of a selected machine 10 when the wheels 36 abut the stops 42. This provides precise placement of the furnace 20 with respect to the machine 10 so that the molten material can be safely transferred to the machine 10 by manual or automated ladling, without spilling.

In use, the furnace is on a platform adjacent a die cast machine. When the furnace is to be moved to another machine, it is shut off and the electrical and gas power connections are disconnected. A fork lift truck lifts the fixed legs from the floor, and the platform and furnace are pulled out into the aisle. The forks of the lift truck are then placed in the furnace openings. The furnace is lifted from the platform and is transported to the next selected platform. When the furnace is properly positioned on the next platform, the fork lift lifts the fixed legs of that platform and pushes the furnace and platform into position adjacent the next machine. The furnace is guided by the rails and is precisely positioned by pushing the wheels against the stops. Then electricity and gas are connected to the furnace, and the furnace is turned on.

The many advantages of this invention are now apparent. Die cast parts can be mass produced more efficiently because a portable holding furnace can be used to provide molten material to a plurality of die cast machines, including machines of different sizes. The use of fewer furnaces reduces energy requirements and capital costs. Raw material costs are also reduced because it is not necessary to maintain molten raw material in as many furnaces simultaneously. Also, the portable furnace is transported and precisely placed in predetermined positions with respect to the machines in a safe and efficient manner.

While the principles of the invention have been described above in connection with specific apparatus and applications, it is to be understood that this description is made only by way of example and not as a limitation on the scope of the invention.

What is claimed is:

1. A method for transporting a portable furnace in a common area and locating the furnace among at least two die cast machines located on a floor outside of and adjacent to the common area, the furnace being selectively placed in a predetermined location with respect to each of the machines, the predetermined locations also being outside and adjacent the common area, comprising the steps of placing a movable platform adjacent to each of the machines, securing rail means to the floor for guiding each of said platforms, securing stop means relative to each of the machines for precisely positioning said platforms with respect to the machines, each of said platforms having at least one wheel which is guided by said rail means, and at least one fixed leg for securing the platform in place, said platforms further having means for abutting against said stop means, stopping said platforms in the predetermined locations, moving a selected platform into the common area, placing the furnace on said selected platform, and pushing said selected platform out of the common area to its predetermined location, said selected platform being guided by said rail means until said abutting means abuts against said stop means for proper placement of said selected platform with respect to its respective die cast machine.

2. A method of making die cast piece parts comprising the steps of placing a die in each of a plurality of die cast machines, said machines being located on a floor adjacent a common area, placing a furnace platform adjacent each of said machines, said furnace platforms being movable from a first predetermined position with respect to said machines and a second position in said common area, moving one of said platforms into said common area, placing a portable furnace on said platform, moving said platform to said first predetermined position, transferring molten material from said furnace to said machine, moving said platform from said first predetermined position to said common area, and removing said furnace from said platform.

3. Apparatus for transporting a portable furnace to a die cast machine and placing the furnace in a predetermined position with respect to the machine comprising platform means for supporting the furnace, means for placing the furnace on said platform means and removing the furnace from said platform means, said platform means having wheel means at one end and position fixing means at the other end, means for guiding said wheel means end of said platform means to the predetermined position, and means for lifting said position fixing means end of said platform means to move said platform means to and from the predetermined position.

4. The apparatus of claim 3 wherein said wheel means abuts against stop means secured with respect to the machine such that said wheel means abuts against said stop means when the furnace is in the predetermined position.

5. The apparatus of claim 3 wherein said wheel means includes at least two wheels, said guiding means comprising a rail for each of said wheels.

6. The apparatus of claim 5 wherein said wheels include a circumferential groove for said rails, said wheels being supported by a surface on which said rails are secured.

* * * * *